US005434558A

United States Patent [19]

Zeder

[11] Patent Number: 5,434,558

[45] Date of Patent: * Jul. 18, 1995

[54] ANNUNCIATOR APPARATUS FOR MONITORING ELECTRICAL CONNECTIONS

[76] Inventor: Abraham Zeder, 8 Wintergreen Cir., Andover, Mass. 01810

[ * ] Notice: The portion of the term of this patent subsequent to Nov. 2, 2010 has been disclaimed.

[21] Appl. No.: 6,874

[22] Filed: Jan. 21, 1993

Related U.S. Application Data

[63] Continuation-in-part of Ser. No. 725,979, Jul. 5, 1991, Pat. No. 5,258,744.

[51] Int. Cl.[6] ..... G08B 13/26

[52] U.S. Cl. ..... 340/568; 340/644; 340/687; 340/310.08; 200/51.1

[58] Field of Search ..... 340/568, 644, 310 CP, 340/687; 200/51.1

[56] References Cited

U.S. PATENT DOCUMENTS 2,660,663 11/1953 Rahmel ..... 340/310 CP
5,243,328 9/1993 Lee et al. ..... 340/310 CP
5,258,744 11/1993 Zeder ..... 340/568

*Primary Examiner*—John K. Peng
*Assistant Examiner*—Daryl C. Pope
*Attorney, Agent, or Firm*—Pearson & Pearson

[57] ABSTRACT

An annunciator for indicating the removal of an electrical plug from the electrical receptacle. The electrical receptacle includes neutral switching contacts actuated in response to the insertion of a plug into the receptacle. An input circuit in the annunciator apparatus monitors the state of the neutral switching contacts and couples signals produced when a plug is removed to a latching circuit thereby to produce an audible or electrical indication of plug removal. The input Circuit and latching circuit are electrically isolated, and the annunciator detects any attempts to disconnect the apparatus from an external power supply or to remove any internal battery.

26 Claims, 7 Drawing Sheets

30

60

NEUTRAL REFERENCE POWER SUPPLY 201
INPUT CIRCUIT 200
202
292
294
293
222
223
221
220
104n
244
236
234
235
255
243
213
254
252
212
217
218
211
216
214
208
207
210
215
245A
246
245B
253
247
248
242
251
250
241
240g
240
240p
104
104p
104n
104g
+
N
G
-

ANNUNCIATOR APPARATUS FOR MONITORING ELECTRICAL CONNECTIONS

CROSS REFERENCE TO RELATED APPLICATION

This application is a continuation-in-part of my U.S. patent application Ser. No. 07/725,979 filed Jul. 5, 1991 now U.S. Pat. No. 5,258,744 for Annunciator Apparatus for Monitoring Electrical Connections.

BACKGROUND OF THE INVENTION

1. Field of the Invention

This invention generally relates to annunciator apparatus and more particularly to apparatus that announces the unauthorized or inadvertent removal of a plug from an electrical receptacle.

2. Description of Related Art

The removal of an electrical plug from a receptacle is a common occurrence. In many situations this step occurs as a normal event. However, in others this step represents an unauthorized or inadvertent action that requires some immediate response. For example, removing the plug of an electrical appliance in a store may indicate that someone is stealing the appliance. In other situations the removal of the plug may indicate that critical apparatus has ceased to function. In these or other situations it is important to announce the occurrence of such a step by audible or electrical signalling.

These situations, particularly attempted thefts of electrical equipment, have led to the development of various theft deterring apparatus. The simplest apparatus for deterring theft comprises mechanical locking assemblies, such as cables and locks, that physically bind an appliance to a wall, counter or other fixture to prevent its physical removal. Such mechanical assemblies, however, can be cumbersome to use, especially in stores where individuals properly may move the appliances. It is relatively easy for an individual intent on stealing the appliance to defeat these mechanical locking assemblies and remove the appliance. Moreover, these assemblies do not inherently have any capability to announce the occurrence of unauthorized actions.

There is a range of alarms and other annunciator apparatus that provides on-site or remote signalling that are used in a theft deterring role. In one approach electrical receptacles are modified to provide mechanical or optical switching functions that respond to the presence or absence of a ground or neutral plug terminal or the like. Alarm circuits provide an alarm whenever a plug is not present. The following U.S. Pat. Nos. disclose various embodiments of such apparatus:

| | | |
|---|---|---|
| 3,090,948 | (1963) | Cremer |
| 3,192,518 | (1965) | Sliman |
| 4,097,843 | (1978) | Basile |
| 4,591,732 | (1986) | Neuenschwander |
| 4,845,719 | (1989) | Posey |

In accordance with other approaches separate electronic monitoring units mount on appliances or centrally disposed electronic circuits monitor wire lengths or other conditions that could indicate the removal of an electrical plug. The following U.S. Pat. Nos. disclose apparatus of this general category:

| | | |
|---|---|---|
| 4,327,360 | (1982) | Brown |
| 4,680,574 | (1987) | Ruffner |
| 4,736,195 | (1988) | McMurtry et al |
| 4,945,335 | (1990) | Kimura et al |

The following U.S. Pat. Nos. disclose apparatus that monitors the insertion or removal of a plug from a receptacle:

| | | |
|---|---|---|
| 4,075,617 | (1978) | Wireman |
| Canada 547,706 | (1957) | Barnes |
| 4,028,691 | (1977) | Zeder |
| 4,658,242 | (1987) | Zeder |
| 4,935,725 | (1990) | Turan |

The Wireman patent discloses a structure including modified poles in an electrical receptacle. Specifically each receptacle contains an added spring coil between a neutral connection and an auxiliary contact. The auxiliary contact has insulating portions on either side of a conductive portion. Each insulating portion isolates the neutral and auxiliary connections when a plug is either in place or removed. A momentary contact occurs as a plug is inserted or removed. Alarm circuitry associated with the receptacle responds to both transient conditions by sounding an alarm. An operator must shift the system to a test mode to disable the alarm circuit before inserting a plug. If the system is not in a test mode, plug insertion will produce an alarm. Thus, this apparatus may produce false indications of problems unless specific operating steps are followed.

The Barnes patent discloses a current responsive signalling device. The insertion of a plug into the device brings a contact bar into circuit with a pair of contact arms. If the plug is removed, the circuit through the contact bar and contact arms is broken. If multiple plug positions are included in a receptacle, plugs or alternative devices apparently must be inserted in both receptacle positions to silence any alarm. Otherwise the connection between different contact arms apparently would be broken by an empty receptacle position. This condition interrupts current through a relay causing a switch to close and sound the alarm.

In accordance with the Zeder U.S. Pat. No. 4,028,697, filed by the same Applicant as the present invention, a plunger extends through the center of each receptacle of a duplex outlet. Each plunger controls corresponding external switching contacts that constitute an input to an alarm circuit. Any time a plug is removed, spring bias on the corresponding switch contacts opens the switch and an alarm sounds. A special cover can be located in any unused pole position to prevent erroneous alarms, but such covers are subject to being lost. The plunger can be broken; when this occurs, the entire receptacle must be replaced. It is also possible to block the plunger while the plug is installed and then remove the plug without any alarm. Despite these characteristics, apparatus constructed in accordance with the Zeder patent has been accepted for a number of applications where theft deterrence and other monitoring are important.

In accordance with the Zeder U.S. Pat. No. 4,658,242, filed by the same Applicant as the present invention, an alarm circuit relies upon a low impedance through an appliance to disable or inhibit an alarm. More specifically, so long as a low impedance exist between certain terminals, voltages established in the circuit prevent a detector circuit and latch from sounding an alarm. When the impedance between these terminals increases, as by removal of the appliance or by turning off the appliance, the signals shift and enable the alarm to sound. If no appliance is present the alarm sounds. Consequently a low impedance device, such as a jumper, must be connected in the detection circuit to prevent false alarms. If multiple positions are available for receiving components, then if any position is empty, the alarm sounds.

The Turan patent discloses a security system for merchandise and electrical appliances and telephones. The security system includes an electrical receptacle having a plurality of output locations. A modular socket removably engages with outlet locations in the receptacle. When engaged, electrical contacts in the socket are connected to corresponding electrical contacts in the receptacle. The socket is adapted to receive a plug in an electrical and mechanical engagement. If the plug is removed from the socket or a cable connected to the plug is cut, an alarm sounds. However, removal of the socket from the receptacle does not apparently produce an alarm. Moreover, if an installed socket is empty an alarm will sound.

SUMMARY

Therefore it is an object of this invention to provide apparatus that reliably announces the unauthorized or unintentional removal of a plug from a receptacle.

Another object of this invention is to provide annunciator apparatus that is reliable and simple to operate.

Still another object of this invention is to provide an annunciator apparatus that is reliable and simple to operate and sounds an alarm in response to a variety of different influences.

Annunciator apparatus constructed in accordance with this invention monitors the transition of an electrical switch in an electrical circuit from a first state to a second state. An input circuit produces first and second transition signals in response to switch transitions from the first to the second state and from the second to the first state respectively. Transition sensing produces transition sensed signals in response to the first transition signals. Annunciators respond to the transition sensed signal by producing an alarm.

In accordance with other aspects of this invention, an isolating signal transfer means is interposed between the input circuit and the annunciators, and the input circuit means and annunciators are energized by first and second, independent and isolated power supplies. This isolation minimizes the possibility of electrical noise signals from inducing a false alarm. In addition, the apparatus is adapted to announce any attempt to disconnect the annunciator apparatus from external power or to remove a backup battery in either power supply.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
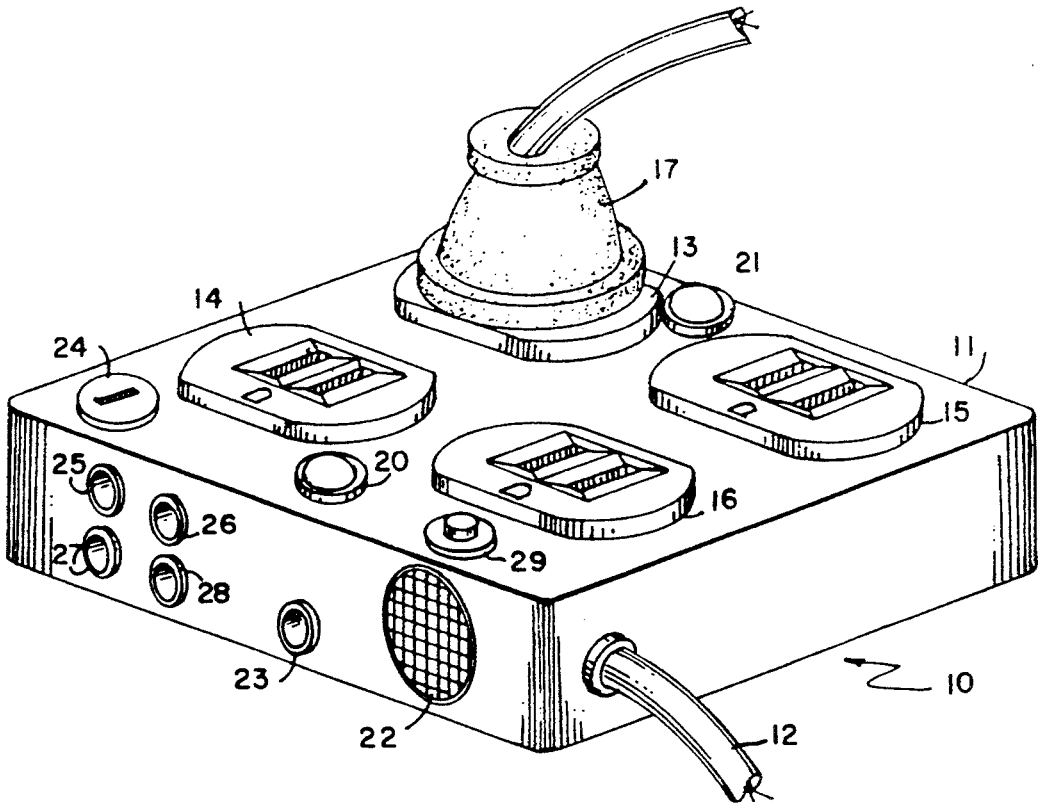
FIG. 1 is a perspective view of an embodiment of an annunciator apparatus adapted for use with this invention.

FIG. 1 discloses one embodiment of annunciator apparatus 10 constructed with a housing 11 and a power cord 12 that connects to a standard 120- or 240-volt AC supply with power and neutral conductors and normally a ground conductor. Typically the power cord connects to a receptacle in a secure location remote from the apparatus being monitored.

The specific apparatus 10 in FIG. 1 has four receptacle positions 13, 14, 15 and 16 and depicts a single plug 17 inserted in receptacle position 13. Normally the receptacle positions 13 and 14 and associated structure are combined in a single duplex outlet. Similarly another duplex outlet can define the receptacle positions 15 and 16. In the following discussion the term "receptacle" means to include the structure associated with a "receptacle position". Detailed receptacle structures are discussed in more detail later in connection with FIGS. 2 and 3.

An indicator light 20 illuminates whenever AC power energizes the receptacles 13 through 17. An alarm light 21 illuminates as a visual indictor that the alarm circuitry is working. An audio alarm sounds from a speaker 22, and a relay jack 23 provides a means for indicating an alarm to a remote location if connected to normally open or normally closed relay contacts inside the housing 11. A key-operated reset switch 24 provides a means for authorized personnel to clear the various alarm indications after an alarm condition; the alarm light 21 extinguishes whenever the reset switch 24 is active. The housing 10 additionally includes a plurality of input jacks 25, 26, 27 and 28 that adapt the apparatus for monitoring remote locations in response to external switch contacts. A circuit breaker reset button 29 allows personnel to reset an internal circuit breaker that provides overload protection.

If the apparatus 10 is operating in the configuration shown in FIG. 1, both the power indicator 20 and the alarm light 21 are lit. An authorized removal of the plug 17 requires personnel to operate the key-operated reset switch 24 to block any alarm by disabling the alarm circuit. When this occurs, the alarm light 21 turns off. Then the individual returns the reset switch 24 to a normal position and enables the alarm circuit and the alarm light 21 turns on again. If someone removes the plug without authorization, the apparatus 10 announces the action. Specifically, the speaker 22 produces an audible alarm and the relay contacts associated with the relay jack 23 change state. This alarm annunciation continues until authorized personnel activate the reset switch 24. If someone inserts a plug into the receptacle 14, 15 or 16, no alarm occurs. No alarms occur as a result of the absence of any plug in any receptacle position. Only the removal of a plug without authorization produces an alarm.

Figure 2:
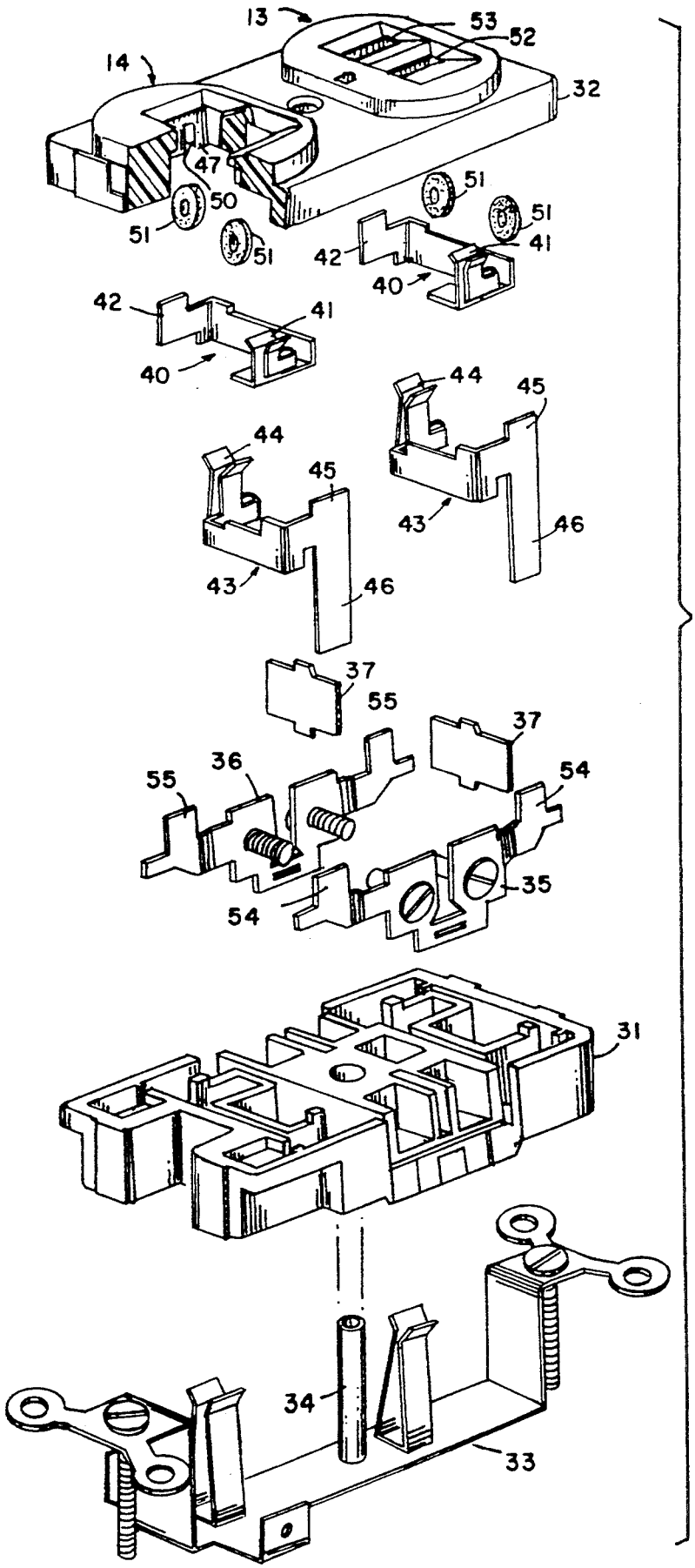
FIG. 2 is an exploded perspective view of the components of one embodiment of an electrical receptacle adapted to be used in the apparatus of FIG. 1.

FIG. 2 discloses one embodiment of a standard duplex outlet 30 that is useful with an apparatus embodying this invention. For purposes of explanation it is assumed that the duplex outlet 30 corresponds to the duplex outlet that provides receptacle positions 13 and 14 in FIG. 1. The outlet 30 includes an insulating base 31 and a complementary insulating cover 32 that form a receptacle having diverse barriers and internal cavities for accepting and supporting the various conductive and other internal components of the receptacle. A ground strap 33 with a central rivet 34 that passes through apertures in the housing 31 and cover 32 clamps the various parts together. A neutral wiring terminal 35 and power wiring terminal 36 in parallel side cavities of the housing 31 provide a means for affixing power and neutral ac supply conductors to the duplex outlet 30. Insulating spacers 37 provide an insulating barrier if it is desired to separate the two poles by severing links on the terminals 35 and 36.

A U-shaped power contact engaging structures 40 with spaced female contacts 41 and a tab 42 on opposite legs of the U-shaped structure lies in other cavities of the housing 31. Neutral contact engaging structures 43 have a similar structure with female contacts 44 and tabs 45. In accordance with this invention, however, the neutral contact engaging structures 43 are modified by adding downward extensions 46 from the tab 45. Each extension 46 passes through and exits externally to the base 31 and thereby constitutes a conductive feed-through means.

The cover 32 has an internal barrier and slot, such as the barrier 47 and slot 50 shown with respect to the receptacle 14 that receives an activating disk 51. Activating disks 51 are associated with each of the power and neutral contact structures and normally align to the center of the switch with respect to tabs 42 and 45 respectively. When the duplex outlet 30 is assembled, the activating disks 51 also align under the power and neutral slots or apertures 52 and 53 formed at each of the receptacle positions.

As the male terminals of a plug pass through the slots 52 and 53 they force the corresponding activating disks 51 simultaneously toward the sides of the outlet 30. The activating disks 51 engage and displace the tabs 42 and 45 simultaneously. The tabs 45 contact tabs 54 to connect the neutral terminal 35 and the neutral contact structures 43. A similar action brings the tabs 42 into contact with the tabs 55 on the power wiring terminal 36. When a plug is removed from the receptacle, the tabs 42 and 45 return to an unbiased state and separate from the tabs 55 and 54 thereby breaking any electrical contact between them. The tabs 42 and 55 and the tabs 45 and 54 constitute electrical switches with first and second switching terminals. In this embodiment the disks 51 act as switch actuators that respond to the insertion of plug contacts into the receptacle.

Figure 3:
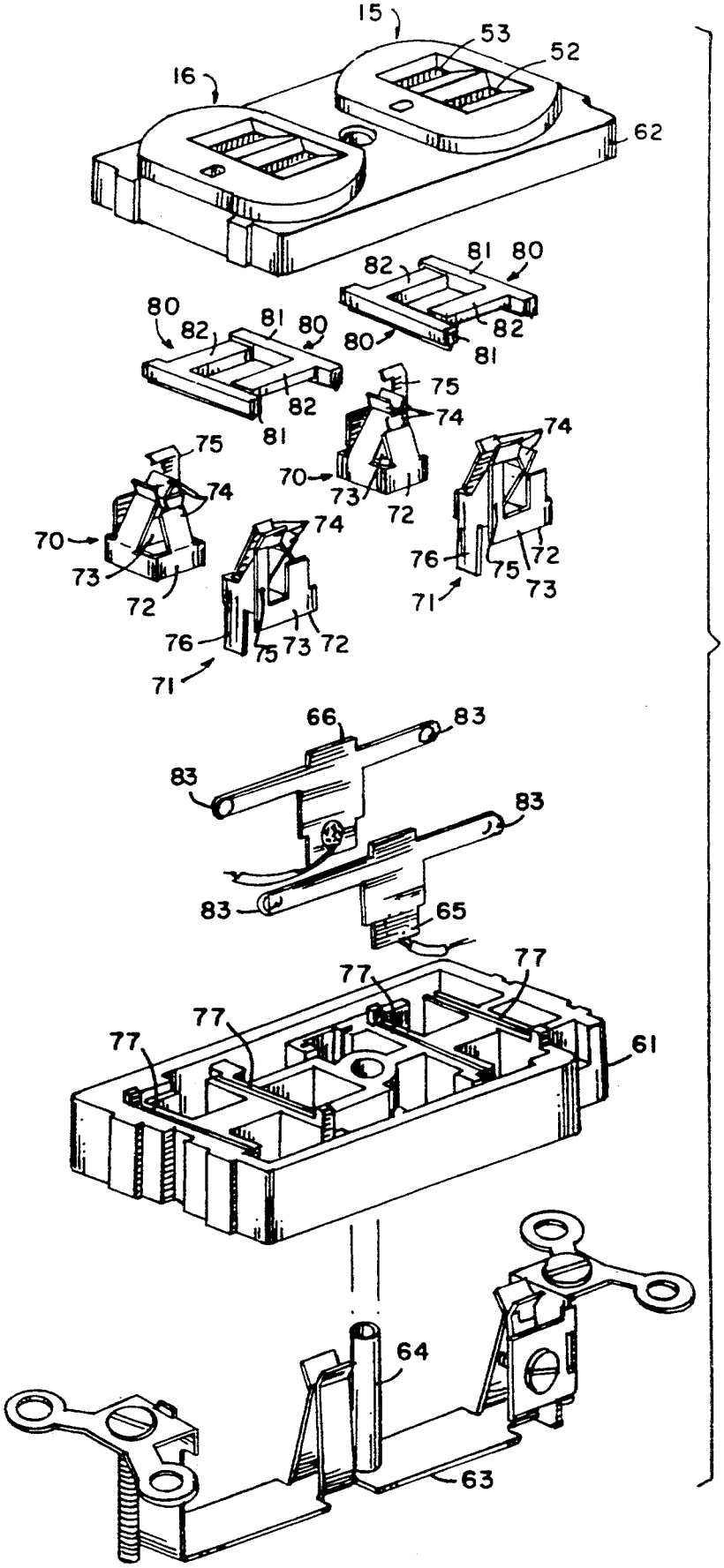
FIG. 3 is an exploded perspective view of another embodiment of an electrical receptacle adapted to be utilized in the apparatus of FIG. 1.

FIG. 3 discloses another embodiment of a standard duplex outlet 60 that is modified for use with this invention. It is assumed that the duplex receptacle 60 corresponds to the duplex outlet that provides receptacle positions 15 and 16. The outlet 60 comprises an insulating base 61 and an insulating cover 62. A ground strap 63 with a rivet 64 clamps the various parts of the outlet 60 in an assembly. A neutral wiring terminal 65 and a power wiring terminal 66 lie in cavities adjacent opposite sides of the housing 61.

Power contact structures 70 and neutral contact structures 71 lie in internal cavities adjacent the power and neutral wiring terminals 66 and 65. Each contact structure generally has a square base 72 with one elongated side 73 that generally extends beyond the square. Three upstanding legs 74 with flared upper portions form a universal female contact that accepts different plug contact configurations. The cover 62 with its straight slots, such as slots 52 and 53, defines which of the pairs of female contacts 74 will engage the plug contacts. An extension 75 from the elongated side 73 on each of the power and neutral contact structures 70 and 71 extends toward the cover 62. In accordance with this invention the neutral contact structures 71 have extensions 76 that exit the housing 61.

Transverse slots 77 formed in the base 61 serve as tracks for L-shaped activators 80. Each activator has a leg 81 that rides on one of the tracks. An extension 82 at right angles to the leg 81 is offset from the end to align with one of the female contacts and to block access to the slots 52 and 53. A remote end of each leg 81 abuts one of the extensions 75 that normally is spaced from a contact 83 on a corresponding one of the neutral and power terminals 65 and 66.

When the male terminals of a plug enter through the slots 52 and 53, they engage corresponding extensions 82 and force them together so the end portions displace the extensions 75 into the respective contacts 83. When the plug is removed, the extensions 75 return to an unbiased condition and break the contacts between the terminals 65 and 66 and the corresponding contact structures 71 and 70.

Thus, FIGS. 2 and 3 disclose diverse embodiments of electrical outlets with modified receptacles. The base 31 and cover 32 in FIG. 2 and the base 61 and cover 62 in FIG. 3 support electrical plugs. Each receptacle contains neutral and power wiring terminal means in the form of the terminals 35 and 36 and 65 and 66. Each receptacle contains contact means for engaging the male contacts on a plug in the form of the female contact structures 41 and 44 in FIG. 2 and contact structures 74 in FIG. 3. Each receptacle contains an electrical switch in a form of the tabs 45 and 54 in FIG. 2 and the extensions 75 and contacts 83 in FIG. 3 that shift between a first, or closed state when a plug is inserted to a second, or open, position when the plug is removed. The activating disks 51 and the activators 80 in FIGS. 2 and 3 respectively constitute a switch actuating means that responds to the insertion of the plug contacts into the receptacle for closing the electrical switching means. The extensions 46 and 76 in FIGS. 2 and 3 constitute conductive means connected to the neutral switching means that extend through the receptacle means.

Figure 4:
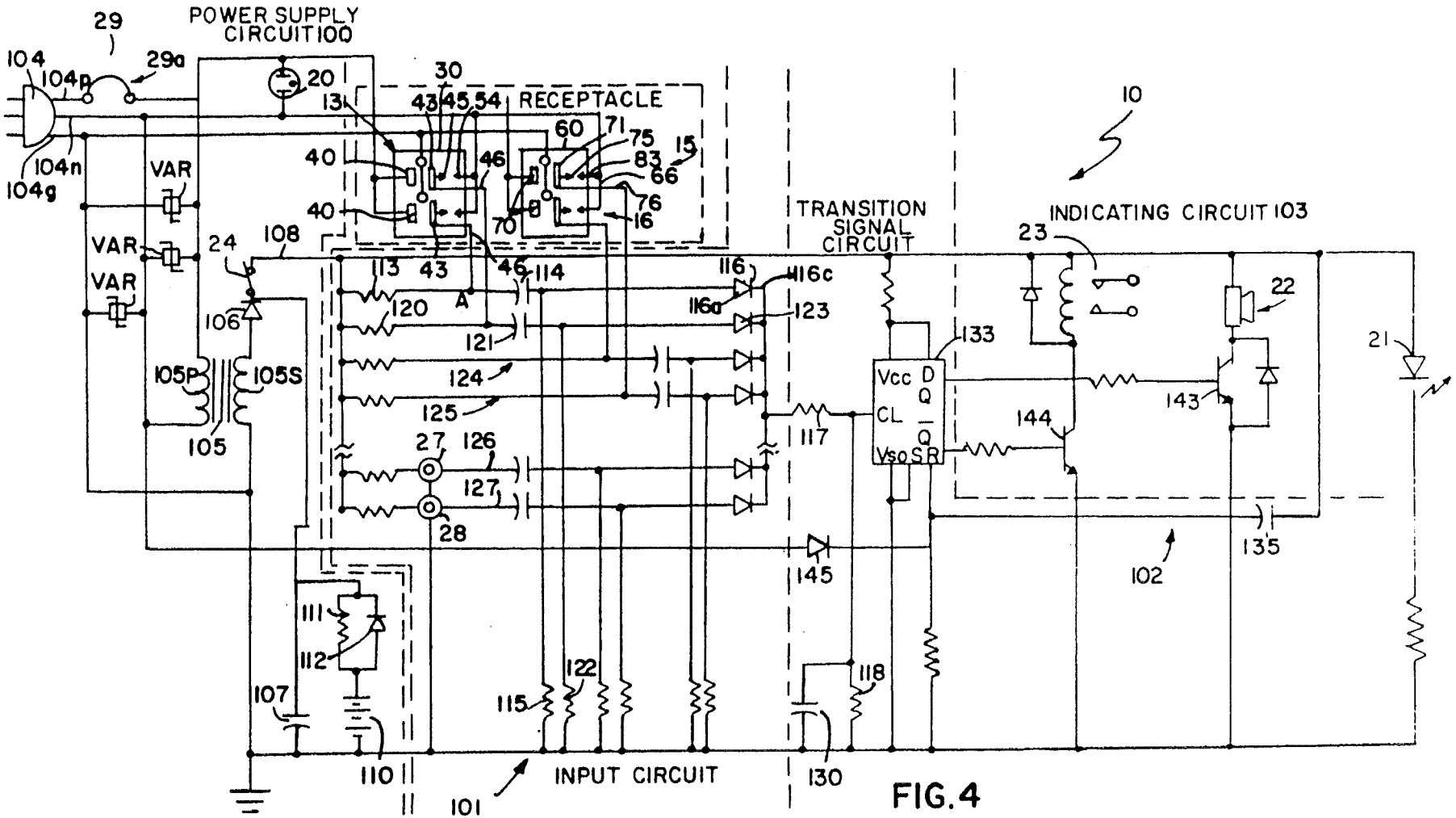
FIG. 4 is a schematic view of one embodiment of a circuit that is useful with the apparatus of FIG. 1.

The schematic of FIG. 4 illustrates one embodiment of an alarm or annunciator circuit for installation in the housing 11 of FIG. 1 and for operation with receptacles such as shown in FIGS. 2 and 3 or any other electrical device that uses a switch to identify particular events. In general terms, the annunciator circuit of FIG. 4 includes a power supply circuit 100 that connects to an AC supply for producing various power supply voltages for the annunciator circuit. An input circuit 101 monitors the various switching contacts to produce first and second transition signals. In accordance with this embodiment, the input circuit 101 produces a first transition signal when a plug is removed from a receptacle and a second transition signal when the plug is inserted. A transition signal circuit 102 monitors the input circuit 101 and responds to a first transition signal by generating a transition sensed signal that activates the various annunciator elements in an indicator circuit 103.

The power supply circuit 100 includes a plug 104 that connects a power conductor 104*p*, a neutral conductor 104*n* and ground conductor 104*g* to an external AC power source. The AC power indicator 20 in FIG. 1 comprises a neon lamp 20 connected across the power and neutral conductors 104*p* and 104*n* on the load side of a circuit breaker 29*a* that includes the reset button 29 shown in FIG. 1. Varistors (VAR) or other spike suppression elements connect between the various conductors.

The conductors 104*p* and 104*n* and 104*g* connect to the various receptacles in the outlets 30 and 60. FIG. 4 depicts schematically the receptacle 30 with its power contact structures 40 and neutral contact structures 43. Spaced arrows 45 and 54 represent the normally open switching position of tabs 45 and 54 and a conductor 46 represents the extension 46. Likewise FIG. 4 schematically depicts the receptacle 60 with its power and neutral contact structures 70 and 71, the extensions 75, the contacts 83 on the neutral wiring terminal 66 and the conductor 76 that represents the extension 76 from the neutral contact structure 71. So long as the plug 104 is plugged into a powered electrical outlet and the circuit breaker 29*a* is closed, the lamp 20 is on and the outlets 30 and 60 are energized. The circuit breaker 29*a* provides overload protection for the appliances or other electrical devices that plug into the outlets 30 and 60.

The power supply 100 also includes a transformer 105 with a primary 105P connected to the power and neutral conductors 104*p* and 104*n*. A secondary 105S connects to the ground conductor 104*g* and to a rectifier circuit comprising a diode 106 and a filter capacitor 107 that provides a filtered DC output voltage. The normally closed reset switch 24 couples this DC output voltage onto a DC bus 108.

A rechargeable battery circuit including battery 110, a charge limiting resistor 111 and a blocking diode 112 enable the alarm functions in the circuit to operate even if the plug 104 temporarily disconnects from the remote power supply 100. While an AC voltage energizes the transformer primary 105P, the rectifier circuit provides a trickle charge to the battery 110 through the resistor 111. When the AC voltage is removed, the battery 110 discharges through the diode 112 to provide power to the remainder of the circuit.

The input circuit 101 has a number of analogous circuit legs for each of the receptacles 13 through 16. In a first leg a resistor 113 connects between the DC bus 108 at a junction A of the extensions 46 from the receptacle 14 and a capacitor 114. A resistor 115 connects to ground and to a junction formed by the other side of the capacitor 114 and the anode terminal of a diode 116. The capacitor 114 and resistor 115 constitute a high pass filter that produces first and second transition signals in response to each shift in state of the neutral terminal switching means constituted in the receptacle 30 by the tabs 45 and 54. When a plug is inserted in a receptacle 14, the tabs 45 and 54 are in contact, so the junction A is maintained at a ground potential. When the plug is removed, the tabs 45 and 54 separate, so the potential at junction A shifts to the voltage on the DC bus 108. The high-pass filter circuit comprising the capacitor 114 and 115 converts this transition into a positive going pulse at the anode terminal 116*a* of the diode 116. This pulse then passes through the diode 116 to the resistor 117 and a resistor 118 in the transition signal circuit 102.

When a plug is inserted, the voltage at junction shifts to ground, and the filter circuit comprising the capacitor 114 and 115 converts this transition into a negative going pulse. However, the diode 116 blocks this pulse from reaching the resistor 117 and 118. Thus, the diode 116 is an example of a unidirectional conducting means in series between the high pass filter means and the transition signal circuit that couples only the first transition signals constituted by positive pulses to the transition signal circuit 102.

A second input leg of the input circuit 101 comprises a resistor 120 between the DC bus 108 and a capacitor 121, the junction of the resistor 120 and 121 being connected to the extension 46 from the receptacle 13. The capacitor 121 and another resistor 122, that connects to ground, form another high pass filter that connects to a diode 123. Similar input legs 124 and 125 connect to monitor the switching contacts in each of the receptacles 16 and 15 associated with the duplex outlet 60.

FIG. 4 additionally shows two analogous input legs 126 and 127 for monitoring the input jacks 27 and 28 of FIG. 1. If such jacks connect to remote switches with grounded contacts, the input resistors and high pass filters in each of legs 126 and 127 provide first and second transition signals that monitor those remote switching contacts.

All the diode cathodes, such as the cathode 116*c*, connect in common to provide a logical OR input to the transition circuit 102, particularly an input voltage divider comprising the resistor 117 and resistor 118. A capacitor 130 in parallel with the resistor 118 bypasses certain noise signals that may appear in the circuit to the ground conductor 104*g* thereby minimizing false input signals and alarms in response to such noise signals.

Whenever a plug is removed, the leading edge of the resulting positive-going pulse through the resistors 117 and 118 in the transition signal circuit 102 produces an input signal for a bipolar latching means in the form of a D-type latch 133. The clocking (CL) input connects to the junction of the resistors 117 and 118; the data (D) input, to the DC bus 108 through a coupling resistor; and the overriding set (S) input to ground. As known, with the D input held at a high potential, a positive-going signal transition at the CL input sets the latch 133. When the latch 133 is set, the Q output is at a positive, or TRUE, level and the $\overline{Q}$ output is at a ground, or FALSE, level.

The transition signal circuit 102 additionally includes an initializing circuit in the form of a capacitor 135 between the DC power bus 108 and the overriding reset (R) input of the latch 133. When power is first applied to the power supply circuit 100, initial transients could cause a false clocking signal to be applied to the latch 133 without the capacitor 135. During this interval, however, the capacitor 135 maintains an active input at the overriding reset (R) input of the latch 133, so it can not set for an initial startup interval. These transients cease and stable operating conditions exist before the capacitor 135 charges the input signal to the overriding reset (R) input shifts to enable the latch 133 to respond to clocking inputs.

Any time a set of contacts being monitored by the input circuit 101 shifts from a closed to an open condition, the latch 133 sets and remains set until authorized personnel activate the reset switch 24. When this occurs, the normally closed contacts of the switch 24 open and interrupt the power on the DC bus 108 thereby to disable the alarm circuit. This condition remains until the reset key operated switch 24 returns to its operating condition (i.e., to close the contacts) whereupon power is again applied to the DC bus 108 to enable the alarm circuit latch 133 to respond to a clocking signal.

The specific indicating circuit 103 in FIG. 4 provides audible and electrical indications whenever an alarm condition exists. When a plug is removed and the latch 133 sets, a switching circuit, including a switching transistor 143, closes and establishes a return path for an audio generator, represented by the speaker 22, to produce an audible signal.

As shown in FIG. 4 normally opened contacts in the relay 23 provide an electrical annunciation. In this particular embodiment another switching circuit including a switching transistor 144 connects to the $\overline{Q}$ output of the latch 133 to energize the relay 23 and close the contacts during normal operations. When the latch 133 sets, the switching transistor 144 stops conducting, so the relay contacts open until the latch 133 resets. Thus continuity through the relay jack 23 in FIG. 1 indicates proper operation while a discontinuity indicates an abnormal condition.

In many applications external devices can produce significant noise signals on the power line between the neutral conductor **104*n* and the ground conductor 104*g*. The input circuit 101 inherently blocks any noise signals that drive the neutral conductor 104*n* negative with respect to the ground conductor 104*g*. A diode 145 provides noise immunity with respect to any signals that drive the neutral conductor 104*n* positive with respect to the ground conductor 104*g*. Noise signals of positive polarity could filter through the receptacles 13 through 16 and the input circuit 101 and appear as positive-going transitions at the CL input of the latch 133 thereby generating false annunciations. However, the diode 145, with its anode connected to the neutral conductor 104*n* and its cathode connected to the reset (R) input of the latch 133, couples such positive noise signals in parallel to the reset (R) input. Given the relative time delays through the input circuit 101, positive polarity noise signals produce an overriding resetting action at the latch 133 before the noise driven transition signals arrive at the CL input. Thus, the diode 145 provides immunity with respect to noise Signals of a positive polarity by disabling the operation of the latch 133** for the duration of the noise signals.

It is important that an annunciator circuit such as shown in FIG. 4 dependably produce alarms whenever a plug is removed from a receptacle as that circuit does. It is also important that the circuit does not produce false alarms. Certain conditions can exist in actual practice, beyond the production of short transient signals, that still can falsely trigger an alarm even in the circuit of FIG. 4. This results because electrical codes only permit ground and neutral conductors to connect together at a service entrance. In a correctly operating electrical network, ac current flows in the power conductor **104*p* and the neutral conductor 104n, but not the ground conductor 104*g*. This produces a finite voltage drop along the neutral conductor 104*n* with respect to the ground conductor 104*g*. This ground-to-neutral voltage can not be predicted. It depends upon a number of variables including neutral conductor sizes and lengths, current levels in the neutral conductors and any other externally generated noise that is coupled onto the power lines. Turning different appliances on and off also produces power surges that generate transient ground-to-neutral voltages. In other situations the ground-to-neutral voltage assume a steady state condition, as when an appliance under constant load remains energized for an extended period of time. Such a steady state ground-to-neutral voltage can produce an overriding resetting signal at the latch 133 in FIG. 4 thereby disabling the transition signal circuit and the indicating circuit 103**.

It is also important that an annunciator circuit detect any tampering. It has been found that there is a potential for defeating the apparatus shown in FIG. 4 by removing the plug 104 from the power conductors and by removing the battery 110 from the apparatus.

Figure 5:
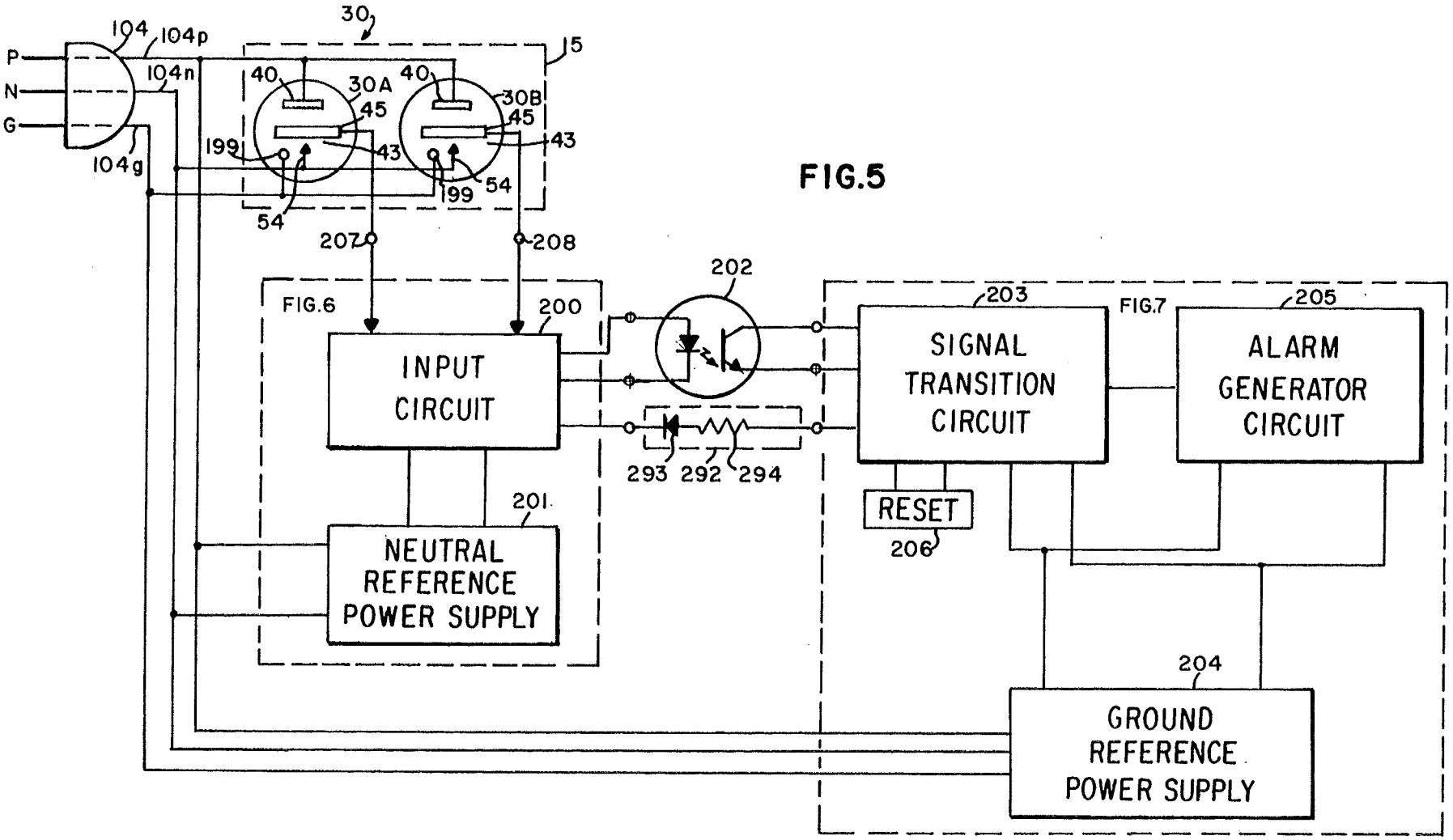
FIG. 5 is a block diagram of an embodiment of a circuit that is useful in the apparatus of FIG. 1 and that includes an input circuit and an indicating circuit, each with its own power supply.
Figure 6:
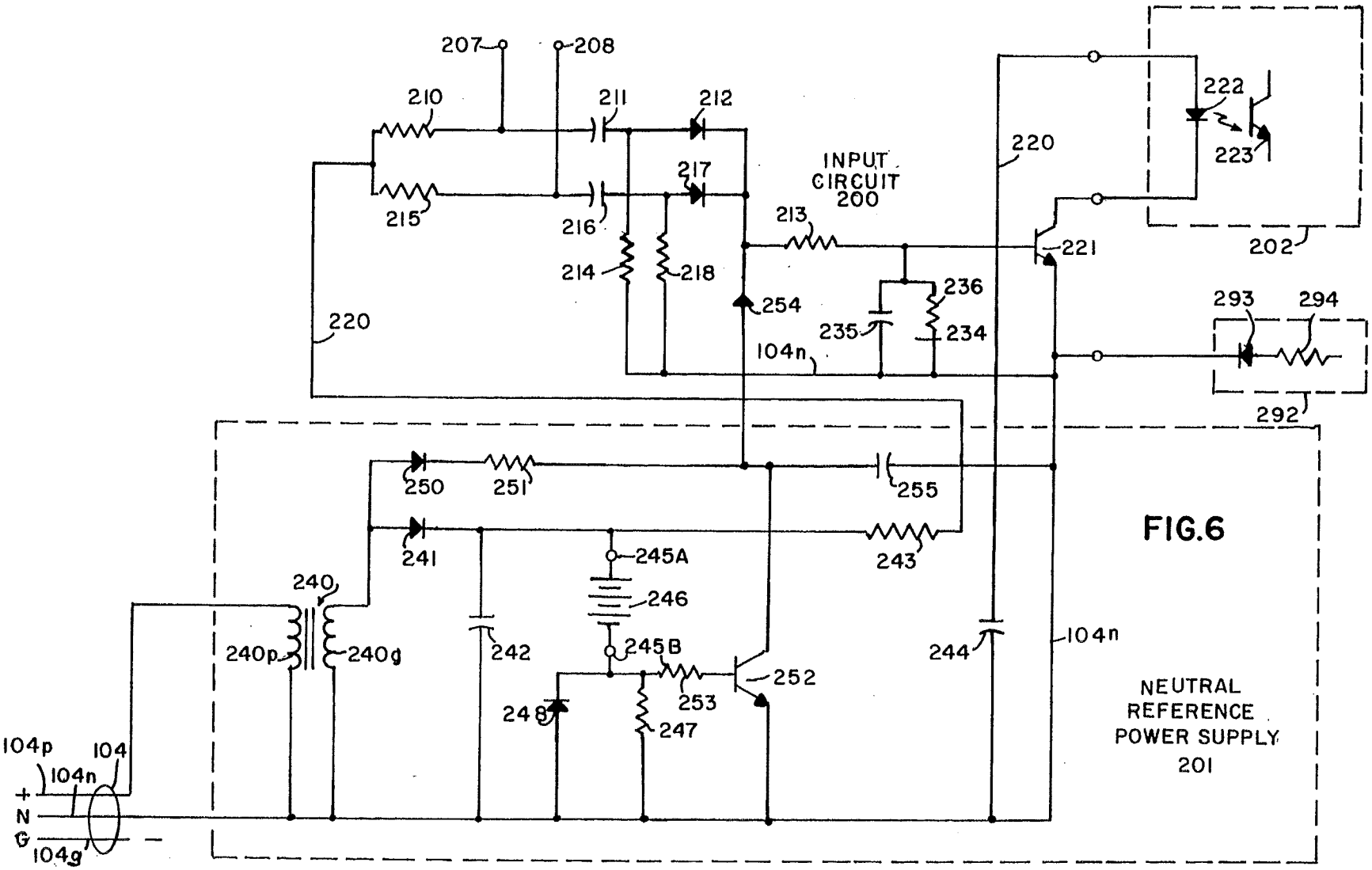
FIG. 6 is a detailed diagram of the input circuit and its power supply shown in FIG. 5.
Figure 7:
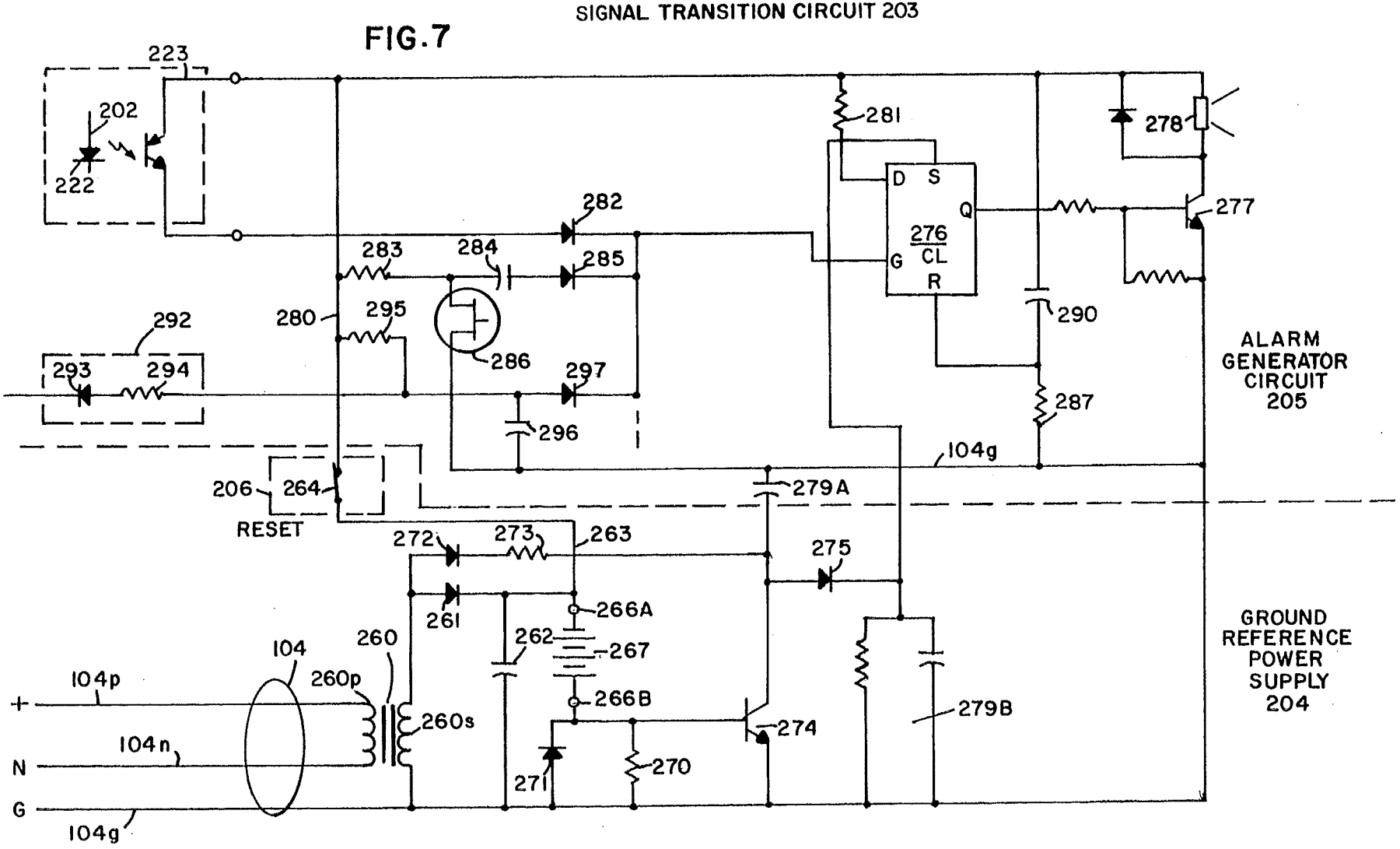
FIG. 7 is a detailed circuit diagram of the indicating circuit and its power supply shown in FIG. 5.

The circuiting shown in FIGS. 5 through 7 provides these problems. As the circuit represents a modification of FIG. 4, identical reference numerals are applied to elements that appear in both FIGS. 4 and 5. Thus the circuit in FIG. 5 includes the plug 104 that can be plugged into a standard receptacle to the power conductor **104*p*, neutral conductor 104*n* and ground conductor 104*g*. The plug 104 thereby acts to releasably connect the apparatus to respective ones of the power conductor 104*p*, the neutral conductor 104*n* and the ground conductor 104*g*. Varistors or other devices (not shown) can connect among these three conductors, as shown in FIG. 4. The circuit also includes a receptacle with a duplex outlet or receptacle 30 that includes two outlets 30A and 30B. Power contact structures 40 connect to the power conductor 104*p*. Switching neutral contacts 54 of neutral contact structures 43 are connected in parallel to the neutral conductor 104*n* while ground contacts 199 are connected in parallel to the ground conductor 104*g*. Tabs or switching terminals 45 in each neutral contact structure 43 connect individually to an input circuit 200**.

A neutral reference power supply 201 energizes the input circuit 200 and connects to the power conductor **104*p* and neutral conductor 104*n* through the plug 104. An isolating circuit 202 couples signals from the input circuit 200 to a signal transition circuit 203. A ground reference power supply 204 energizes the signal transition circuit 203 and an alarm generator circuit 205. The ground reference power supply 204 connects to the power conductor 104*p*, the neutral conductor 104*n* and the ground conductor 104*g*. The combination of the neutral reference power supply 201, the ground reference power supply 204 and the isolating circuit 202 minimizes the possibility that a ground-to-neutral voltage will generate a false alarm. A reset circuit 206 enables an operator to reset the annunciator circuit of FIG. 5. As will be apparent, this reset circuit 206 can be associated with the key-operated reset switch 24 in FIG. 1**.

The input circuit 200 and the neutral reference power supply 201 are shown in detail in FIG. 6. Referring now to FIGS. 5 and 6, the terminals 45 from the outlets 30A and 30B connect respectively to the input circuit 200. In, FIGS. 5 and 6 these conditions are designated as through optional terminals 207 and 208 for purposes of discussion. As shown in FIG. 6, the terminals 207 and 208 connect to high-pass filter and related circuits that are analogous to the high-pass filter and related circuits shown in FIG. 4. More specifically, the terminal 207 connects the junction of a resistor 210 and capacitor 211 that connect through a diode 212 to a resistor 213 and that form a high-pass filter. A resistor 214 connects the junction formed by the capacitor 211 and the anode of the diode 212 to the neutral conductor 104*n*. The terminal 208 connects to the junction between a resistor 215 and capacitor 216 that form another high-pass filter. A diode 217 connects the capacitor 216 to the resistor 213; and a resistor 218 connects the junction of the capacitor 216 and the diode 217 to the neutral conductor 104*n*. The resistor 210 and 215 connect to a voltage supply conductor 220 from the neutral reference power supply 201.

A switching transistor 221 has its base connected to the resistor 213, its emitter to the neutral conductor 104*n*; and its collector to the power supply conductor 220 through the isolating circuit 202. In one particular embodiment, the isolating circuit 202 comprises an electro-optical isolator of conventional design. In FIGS. 5 through 7, this isolating circuit 202 is represented as having a light generator in the form of a light emitting diode 222 and a light responsive switch in the form of a light responsive switching transistor 223. When the switching transistor 221 conducts, current flows through the light emitting diode 222 producing light that places the switching transistor 223 to a conducting state.

A filter 234 comprising a capacitor 235 and parallel resistor 236 connect the base of the transistor 221 to the neutral conductor 104*n*. This bypasses high frequencies from producing base-emitter voltages that could turn the switching transistor 221 on and off at a rapid rate.

If the neutral reference power supply 201 is energized, the removal of a plug from the receptacle 30A and 30B allows the corresponding switching contacts 45 and 54 in the receptacle 30 shown in FIG. 5 to close. This completes a return circuit through one of the resistors 210 or 215 and ties the corresponding terminal 207 or 208 to the neutral conductor 104*n*. When the plug is removed from one of the receptacles, such as the receptacle 30A, the corresponding switching contacts 45 and 54 open so the signal at terminal 207 shifts to the voltage on the conductor 220. The corresponding high pass filter produces a positive going pulse that is coupled through the capacitor 211, diode 212 and resistor 213 to close the switching transistor 221 and produce a signal for transfer across the isolating circuit 202. This operation is analogous to the operation of the input circuit 101 in FIG. 4.

As previously indicated, the neutral reference power supply 201 energizes the input circuit 101 is energized independently of the signal transition circuit 203 and alarm guard circuit 205. More specifically, the neutral reference power supply 201 includes a transformer 240 with a primary 240*p* that connects across the power conductor 104*p* and neutral conductor 104*n*. A secondary 240*s* and series diode 241 produce a half-wave rectified output signal for a filter comprising an input capacitor 242, a resistor 243 and an output capacitor 244. These components produce a positive output voltage on the conductor 220.

The neutral reference power supply circuit 201 also includes terminals 245A and 245B that connect to a battery 246. Normally the battery 246 will be a rechargeable battery and will connect between the output of the rectifier 241 and the neutral conductor 104*n* through a current limiting resistor 247 and a parallel, reversed-biased diode 248. Consequently when the conductors 104*p* and 104*n* are energized, the power supply 201 charges the battery 246 through the current limiting resistor 247. When the conductors 104*p* and 104*n* are not energized, the battery 246 discharges through the diode 248 to supply the current necessary for operating the input circuit 200.

The neutral reference power supply circuit 201 shown in FIG. 6 additionally includes a circuit for detecting any attempt to remove the battery 246. A diode 250 and resistor 251 connect the collector of a switching transistor 252 to the secondary 240*s*. The emitter of the transistor 252 connects to the neutral connector 104*n*. A current limiting resistor 253 couples the base of the transistor 252 to the terminal 245B. A filter capacitor 255 connects the collector to the neutral conductor 104*n*. Whenever the battery 246 is in place, the voltage at the terminal 245B forward biases the base-emitter junction of the switching transistor 252 so the transistor 252 conducts and essentially grounds its collector and the anode of a diode 254 between the collector of the transistor 252 and the resistor 213. During battery operation the voltage across the diode 248 also maintains the switching transistor 252 in a conducting state. However, if the conductors 104 are energized and the battery 246 is removed, there is no current path between the terminals 245A and 245B. The base-emitter voltage shifts to the potential on the neutral conductor 104*n* and the transistor 252 stops conducting. This forward biases the diode 254 and produces a signal that shifts the transistor 221 to a conductive state thereby energizing the light-emitting diode in the isolating circuit 202. The signal transition circuit 203 and alarm generator 205 produce an alarm any time the light-emitting diode 222 is energized.

The ground reference power supply 204 that has a similar structure to the neutral reference power supply 201 shown in FIG. 6 and energizes the signal transition circuit 203 and alarm generator circuit 205. More specifically, a transformer 260 has a primary 260*p* connected across the power conductor 104*p* and the neutral conductor 104*n*. In this circuit, however, the secondary winding 260*s* connects to the ground conductor 104*g* so the voltage produced across the secondary 260*s* is taken with reference to the ground conductor 104*g* and not the neutral conductor 104*n*. A diode 261 and filter capacitor 262 produce a supply voltage on a conductor 263 that is an input to the reset circuit 206 depicted in FIG. 7 as a normally closed switch 264.

The ground reference power supply 204 additionally includes terminals 266A and 266B for receiving a battery 267. The battery 267 normally will be a rechargeable battery and will connect to the ground conductor 104*g* through a current limiting resistor 270 and a diode 271. A battery monitoring circuit includes a diode 272 that connects from the secondary winding 260*s* through a current limiting resistor 273 and switching transistor 274 to the ground conductor 104*g*. If the battery 267 is removed, the transistor 274 stops conducting like the transistor 252 in FIG. 6. However, in the circuit a diode 275 couples the resulting output from the diode 272 and resistors 273 to the overriding set (S) input of a latch 276. This sets the latch 276 and shifts an output switching circuit 277 to a conductive state to energize the alarm generator circuit 205, represented as a speaker 278. A filter capacitor 279A connects the resistor 273 to the ground inductor 104*g*. An R-C filter circuit 279B further filters the signal from the diode to provide a dc signal at the set (S) input of the latch 276.

The power supply voltage on the conductor 263 passes through the normally closed switch 264 to a conductor 280. A resistor 281 couples the power supply conductor 280 to the (D) input of the latch 276. Consequently any positive signal transition at the clocking (CL) input sets the latch 276 in the absence of an overriding setting or resetting signal. In this particular circuit, three possible sources of transition are shown. The isolating device 202 forward biases a diode 282 with the voltage on the conductor 280 thereby to constitute one input that passes through a diode 282 to produce a clocking (CL) input to the latch 276.

The signal transition circuit 203 additionally includes a structure for producing clocking input to the latch 276 in response to external devices. This takes the form of a resistor 283 that forms a high-pass filter circuit with a capacitor 284 between the conductor 280 and a diode 285 that connects to the clocking (CL) input of the latch 276. A normally closed switch or jack 286 ties the junction of the resistor 283 and capacitor 284 to the ground conductor 104*g* normally to inhibit any signal from passing through the diode 285. If, however, conductivity through the switch 286 is interrupted by a contact in an external device, a positive going transition signal will be produced at the input of the capacitor 284 and be coupled to the clocking (CL) input of the latch 276 thereby activating the alarm generator circuit 205.

The circuit shown in FIGS. 5, 6 and 7 additionally includes a monitor 292 that allows an alarm to sound if anyone tampers with the plug 104. This constitutes a third source of clocking signals for the latch 276. More specifically the monitor circuit 292 includes a diode 293, resistor 294, resistor 295 and capacitor 296. The cathode of the diode 293 connects to the neutral conductor 104*n*. The resistor 294 connects the anode of the diode 293 to a junction formed by the resistor 295, capacitor 296 and the anode of a diode 297. The values of the resistors 294 and 295 are selected according two criteria. First, the resistors 294 and 295 must limit current in the diode 294 to levels that are acceptable under electrical codes. Second, the ratio of the resistors 294 and 295 must maintain a voltage across the capacitor 296 at a low level, so the diode 297 is reverse biased when the plug 104 is inserted in a receptacle. So long as the plug 104 is inserted, whether the circuit is externally energized or not, there is a connection between the neutral and ground conductors 104*n* and 104*g*. Consequently, current flows through the monitoring circuit 292. If the plug 104 is removed, the external connection between the neutral conductor 104*n* and the ground conductor 104*g* breaks. Current flow stops so the voltage on the conductor 280 forward biases the diode 297 to produce a clocking transition signal for the latch 276.

After the alarm caused by any of the foregoing or other reasons has sounded, activating the reset circuit 206 occurs by opening tile switch 264. This disables the latch 276 and the alarm generator circuit 205. When the switch 264 closes again, the alarm will not sound until another clocking input reaches the latch 276 or someone attempts to remove the battery.

As was true with respect to the circuit shown in FIG. 4, transient conditions during initial energization could produce an initial false alarm. A startup circuit 287 prevents this from occurring. The startup circuit 287 comprises a capacitor 290 and resistor 291 in series between the power supply conductor 280 and the ground conductor 104*g*. The junction between the capacitor 290 and the resistor 291 connects to an overriding reset (R) input to the latch 276. During an initial energization sequence, essentially the entire voltage drop between the power supply conductor 280 and the ground conductor 104*g* appears across the resistor 291 thereby preventing the latch 276 from setting. After a short interval of time, determined by the RC time constant of the startup circuit 287, essentially the entire voltage drop appears across the capacitor 290 whereupon the input to the overriding reset (R) input of the latch 276 shifts to a nonassertive mode and enables the latch 276 to operate normally in response to clocking transitions.

Therefore in accordance with this invention annunciator apparatus, such as shown in FIG. 1 that includes receptacles as shown in FIGS. 2 and 3 and circuitry of the type shown particularly in FIGS. 4 through 7, overcomes the deficiencies of the prior art. The apparatus distinguishes between plug insertion and removal and produces an alarm only when a plug is removed. If a receptacle is empty or if a plug is inserted, there is no alarm. The circuitry in FIGS. 5 through 7 further minimizes false alarms due to transient or steady state ground-to-neutral voltages, but produces an alarm if someone attempts to unplug the apparatus or remove backup batteries.

The circuit components for implementing the circuitry in FIGS. 4 through 7 are readily available and reliably implemented by persons of ordinary skill in the art. Consequently, annunciator apparatus that embodies this invention is reliable, simple to operate and economical to produce.

This invention has been disclosed in terms of certain embodiments. It will be apparent that many modifications can be made to the disclosed apparatus without departing from the invention. For example, the specific apparatus shown in FIG. 1 contains two duplex outlets. This invention is also adapted for implementation with single receptacle outlets or multiple outlets and with or without remote switch input jacks. The circuitry of FIGS. 5 through 7 can readily accommodate any reasonable number of switches by adding or deleting input legs in the input circuits 101 or 200. The apparatus is shown with specific embodiments of audible and electrical outputs. Other combinations can be included as can other specific alarms. Various modifications can be made to the annunciation circuit of FIGS. 4 through 7. Different bipolar latching circuits can replace the D-type latches 133 and 276. Alternative output signal driver circuits can be added or substituted for the specifically disclosed switching transistor circuits. Different input circuit configurations are also possible. All of these modifications and variations may be made while still achieving some or all of the objectives of this invention. Therefore, it is the intent of the appended claims to cover all such variations and modifications as come within the true spirit and scope of this invention.

What is claimed as new and desired to be secured by Letters Patent of the United States is:

1. In an apparatus for detecting the unauthorized removal of an electrical plug with male contacts wherein said apparatus includes receptacle means with power, neutral and ground terminal means for connection to power, neutral and ground conductors and for receiving the male contacts of the plug and neutral switching means connected to said neutral terminal means for responding to the insertion of the plug into said receptacle means by closing and wherein said apparatus includes annunciator circuit means for indicating the unauthorized removal of the electrical plug from said receptacle meant including input circuit means for producing a transition sensed signal in response to the opening of said neutral switching means when said plug is removed and indicating circuit means for continuously announcing removal of the electrical plug in response to the transition sensed signal, the improvement comprising:

A. first power supply means connected to the power and neutral conductors for producing a neutral-reference supply voltage for energizing said input circuit means, B. second power supply means connected to the power, neutral and ground conductors for producing a ground-reference supply voltage for energizing said indicating circuit means, and C. isolating signal transfer means for energizing said indicating circuit means in response to the transition sensed signal.

2. Apparatus as recited in claim 1 wherein said input circuit means includes signal processing means for generating the transition sensed signal and said indicating circuit means includes alarm generator means for producing a continuous announcement and signal processing means for energizing the alarm generator means and wherein each of said first and second power supply means includes corresponding generating means for generating a power supply voltage for energizing the signal processing means in the input circuit means and indicating means respectively.

3. Apparatus as recited in claim 2 wherein each of first and second power supply means includes battery means in parallel with said corresponding generating means for providing backup power in the absence of electrical power from the power, neutral and ground conductors.

4. Apparatus as recited in claim 3 wherein said battery means is removable and each of said first and second power supply means includes battery monitoring means connected to the corresponding battery means and signal processing means in said input circuit means and said indicating circuit means, respectively, for energizing said respective signal processing means when said battery means is removed thereby to energize said alarm generator means.

5. Apparatus as recited in claim 3 wherein each of said battery means in said first and second power supply means includes a rechargeable battery and means for connecting to said battery thereby to enable said respective power supply means to charge said battery when the power, neutral and ground conductors are energized.

6. Apparatus as recited in claim 2 additionally comprising plug connection means for interconnecting said first and second power supply means to corresponding ones of the power, neutral and ground conductors and unidirectional conducting means connected between said ground reference power supply and said neutral reference power supply and connected to said signal processing means in said indicating circuit means for energizing said alarm generator means when said plug connection means disconnects from the power, neutral and ground conductors.

7. Apparatus as recited in claim 6 wherein each of said first and second power supply means includes battery means in parallel with said corresponding generating means for providing backup power in the absence of electrical power from the corresponding ones of the power, neutral and ground conductors, each said battery means including a rechargeable battery and means for connecting to said battery thereby to enable said respective power supply means to charge said battery when the power, neutral and ground conductors are energized.

8. Apparatus as recited in claim 7 wherein said battery means is removable and each of said first and second power supply means includes battery monitoring means connected to the corresponding battery means and signal processing means in said input circuit means and said indicating circuit means, respectively, for energizing said respective signal processing means when said battery means is removed thereby to energize said alarm generator means.

9. Apparatus as recited in claim 2 additionally including reset switching means connected to second power supply means and said signal processing means in said indicating means operable for deenergizing said alarm generator means.

10. Apparatus as recited in claim 1 wherein said isolating signal transfer means comprises electro-optical isolating means including a light generator means and light-responsive switching means and wherein said signal processing means in said input circuit means includes transition sensed signal switching means in series with said light generator means for controlling the operation of said light generator means in response to the transition sensed signal and said signal processing means in said indicating circuit means includes latching means for energizing said alarm generator means and means connecting said light-responsive switching means to said latching means for causing said latching means to energize said alarm generator means in response to the transition sensed signal.

11. Apparatus as recited in claim 10 wherein light generator means and said transition sensed signal switching means connect across said first power supply means and said transition sensed signal switching means comprises transistor switching circuit means for interconnecting said light generator and said neutral conductor.

12. Apparatus as recited in claim 11 wherein said input circuit means includes signal processing means for generating the transition sensed signal and said indicating circuit means includes alarm generator means for producing a continuous announcement and signal processing means for energizing the alarm generator means and wherein each of said first and second power supply means includes corresponding generating means for generating a power supply voltage for energizing the signal processing means in the input circuit means and indicating circuit means respectively.

13. Apparatus as recited in claim 12 wherein each of first and second power supply means includes battery means in parallel with said corresponding generating means for providing backup power in the absence of electrical power from the power, neutral and ground conductors.

14. Apparatus as recited in claim 13 wherein said battery means is removable and each of said first and second power supply means includes battery monitoring means connected to the corresponding battery means and signal processing means in said input circuit means and said indicating circuit means, respectively, for energizing said respective signal processing means when said battery means is removed thereby to energize said alarm generator means.

15. Apparatus as recited in claim 13 wherein each of said battery means in said first and second power supply means includes a rechargeable battery and means for connecting to said battery thereby to enable said respective power supply means to charge said battery when the power, neutral and ground conductors are energized.

16. Apparatus as recited in claim 12 additionally comprising plug connection means for interconnecting said first and second power supply means to the corresponding ones of the power, neutral and ground conductors and unidirectional conducting means connected between said ground reference power supply and said neutral reference power supply and connected to said signal processing means in said indicating circuit means for energizing said alarm generator means when said plug connection means disconnects from the power, neutral and ground conductors.

17. Apparatus as recited in claim 16 wherein each of said first and second power supply means includes battery means in parallel with said corresponding generating means for providing backup power in the absence of electrical power from the corresponding ones of the power, neutral and ground conductors, each said battery means including a rechargeable battery and means for connecting to said battery thereby to enable said respective power supply means to charge said battery when the power, neutral and ground conductors are energized.

18. Apparatus as recited in claim 17 wherein said battery means is removable and each of said first and second power supply means includes battery monitoring means connected to the corresponding battery means and signal processing means in said input circuit means and said indicating circuit means, respectively, for energizing said respective signal processing means when said battery means is removed thereby to energize said alarm generator means.

19. Apparatus as recited in claim 12 additionally including reset switching means connected to said second power supply means and said signal processing means in said indicating means operable for deenergizing said alarm generator means.

20. In an apparatus for detecting the unauthorized removal of an electrical plug wherein said apparatus includes receptacle means with power, neutral and ground terminal means for connection to power, neutral and ground conductors and for receiving the male contacts of the plug and neutral switching means connected to said neutral terminal means for responding to the insertion of the plug into said receptacle means by closing and wherein said apparatus includes annunciator circuit means for indicating the unauthorized removal of the electrical plug from said receptacle means including input circuit means for producing a transition sensed signal in response to the opening of said neutral switching means when a plug is removed and indicating circuit means for continuously announcing removal of the electrical plug in response to the transition sensed signal, the improvement comprising:

A. first power supply means connectible to the power, and neutral conductors for producing a neutral-reference supply voltage for energizing said input circuit means, B. second power supply means connectible to said power, neutral and ground conductors for producing a ground-reference supply voltage for energizing said indicating circuit means, C. plug connection means for releasably connecting said first and second power supply means to the respective ones of the power, neutral and ground conductors, and D. unidirectional conducting means connected between said ground reference power supply and said neutral reference power supply and connected to said indicating circuit means thereby to initiate a continuous announcing by the indicating circuit means when said plug connection means disconnects from the power, neutral and ground conductors.

21. Apparatus as recited in claim 20 wherein said unidirectional conducting means includes a diode and resistor connected to conduct current to the neutral conductor in said first power supply means and connected to said signal processing circuit in said indicating circuit means and to said second power supply for causing said signal processing circuit to energize said alarm generator means when said plug connection means disconnects from the neutral and ground conductors.

22. Apparatus as recited in claim 20 additionally including reset switching means connected to said signal processing means in said indicating means operable for deenergizing said alarm generator.

23. In an apparatus for detecting the unauthorized removal of an electrical plug wherein said apparatus includes receptacle means with power, neutral and ground terminal means for connection to power, neutral and ground conductors and for receiving the male contacts of the plug and neutral switching means connected to said neutral terminal means for responding to the insertion of the plug into said receptacle means by closing and wherein said apparatus includes annunciator circuit means for indicating the unauthorized removal of the electrical plug from said receptacle means including input circuit means for producing a transition sensed signal in response to the opening of said neutral switching means when a plug is removed and indicating circuit means for continuously announcing removal of the electrical plug in response to the transition sensed signal, the improvement comprising:

A. first power supply means connected to said power and neutral conductors for producing a neutral-reference supply voltage for energizing said input circuit means, B. second power supply means connected to said power, neutral and ground conductors for producing a ground-reference supply voltage for energizing said indicating circuit means, and C. independent battery backup means in each of said first and second power supply means for energizing said input circuit means and said indicating circuit means when the power, neutral and ground conductors are deenergized whereby said backup battery means in said first and second power supplies produce voltages with respect to the neutral conductor and the ground conductor respectively.

24. Apparatus as recited in claim 23 wherein said battery means is removable and each of said first and second power supply means includes battery monitoring means connected to the corresponding battery means and signal processing means in said input circuit means and said indicating circuit means, respectively, for energizing said respective signal processing means when said battery means is removed thereby to energize said alarm generator means.

25. Apparatus as recited in claim 24 wherein each of said battery means in said first and second power supply means includes a rechargeable battery and means for connecting to said battery thereby to enable said respective power supply means to charge said battery when the corresponding ones of the power, neutral and ground conductors are energized.

26. Apparatus as recited in claim 24 additionally including reset switching means connected to said second power supply means and said signal processing means in said indicating means operable for deenergizing said alarm generator.

* * * * *